United States Patent [19]

Porter

[11] Patent Number: 4,815,979

[45] Date of Patent: Mar. 28, 1989

[54] RIGHT ANGLE ELECTRICAL CONNECTOR WITH OR WITHOUT WIPING ACTION

[75] Inventor: Warren W. Porter, Escondido, Calif.

[73] Assignee: NCR Corporation, Dayton, Ohio

[21] Appl. No.: 137,287

[22] Filed: Dec. 23, 1987

[51] Int. Cl.[4] ..... H01R 9/09

[52] U.S. Cl. ..... 439/62; 439/493

[58] Field of Search ..... 439/61, 62, 65–67, 439/76, 86, 91, 492, 493, 496, 497, 591

[56] References Cited

U.S. PATENT DOCUMENTS

| | | | |
|---|---|---|---|
| 3,614,707 | 10/1971 | Kaufmann et al. | 339/17 |
| 3,718,842 | 2/1973 | Abbott, III et al. | 317/101 |
| 3,774,140 | 11/1973 | Reimer | 339/17 |
| 3,825,878 | 7/1974 | Finger et al. | 339/17 |
| 4,029,374 | 6/1977 | Nestor et al. | 439/493 |
| 4,227,767 | 10/1980 | Mouissie | 339/176 |
| 4,509,099 | 4/1985 | Takamatsu et al. | 361/413 |
| 4,552,420 | 11/1985 | Eigenbrode | 339/14 |
| 4,639,057 | 1/1987 | Daum | 439/493 |
| 4,693,529 | 9/1987 | Stillie | 439/67 |
| 4,744,764 | 5/1988 | Rubenstein | 439/62 |

*Primary Examiner*—Gil Weidenfeld
*Assistant Examiner*—Paula A. Austin
*Attorney, Agent, or Firm*—Wilbert Hawk, Jr.; Stephen F. Jewett; Jack R. Penrod

[57] ABSTRACT

An improved connector for attaching a mother board to a daughter board, having a slotted housing, a slotted elastomeric member, and a flexible circuit with numerous conductors. The flexible circuit is wrapped around the elastomeric member with its two free ends ending at the slot of the elastomeric member. The wrapped elastomeric member is located in a chamber in the housing with the slot in the housing communicating with the slot in the elastomeric member so that when the daughter board is inserted into the housing, it engages the free ends of the flexible circuit within the slot of the elastomeric member. The elastomeric member has two semi-cylindrical portions which are separated by a channel at the bottom thereof. The elastomeric member with these semi-cylindrical portions is slightly larger than the chamber of the housing when mounted by fasteners to the mother board. Thus, as the housing is fastened to the mother board, the elastomeric member is compressed causing it to exert more pressure on the electrical contacts of the flexible circuit as they contact the connector pads of the mother board.

7 Claims, 5 Drawing Sheets

RIGHT ANGLE ELECTRICAL CONNECTOR WITH OR WITHOUT WIPING ACTION

BACKGROUND OF THE INVENTION

The present invention is related to right angle electrical connectors, and is more particularly related to right angle electrical connectors for making multiple electrical connections between a daughter board and a mother board.

The present invention is an improvement of the invention described in applicant's co-pending U.S. patent application Ser. No. 92,860 filed Sept. 2, 1987, entitled "Right Angle Electrical Connector". This co-pending application is commonly assigned to NCR Corporation and is hereby incorporated by reference. This previous connector uses an elastomeric member, which has a semi-cylindrical bottom portion, to press a flexible circuit sheet, having conductor patterns on the left side and the right side, against the left row and the right row of printed circuit board pads, respectively. These two rows of printed circuit board pads are separated by a non-conducting strip of he printed circuit board. The drawback of this design is that most of the pressure from the semi-cylindrical portion of the elastomeric member impinges upon the non-conducting strip of the printed circuit board and not against the printed circuit connector pads. Thus, to achieve the desired pressure against the printed circuit connector pads, the substantially-unused pressure against the non-conducting strip of the printed circuit board must be increased to an even higher level.

U.S. Pat. No. 3,795,884 issued Mar. 5, 1974 to Kotaka for "Electrical Connector Formed From Coil Spring" discloses a connector for connecting conductors on printed circuit boards using conductors formed from an axial cut spring. FIG. 8 shows a plurality of the patented connectors for making right angle connections between a mother board and a plurality of daughter boards.

U.S. Pat. No. 3,924,915 issued Dec. 9, 1975 to Conrad for "Electrical Connector" discloses an electrical connector having a body member, a sheet of flexible insulative material formed around the body member, a series of contact members on the outer face of the insulative material, and resilient means for urging the insulative material away from the body member.

U.S. Pat. No. 4,517,625 issued May 14, 1985 to Frink et al. for "Circuit Board Housing With Zero Insertion Force Connector" discloses a circuit board housing for electrically coupling at least one circuit board to a mother board. A flexible insulation layer is formed around a pair of pad members and a resilient member. The edge of a circuit board is placed between the pad members, and a pair of jaws clamp the pad members into engagement with the circuit board. The resilient member is rotatable from a first position which is not in engagement with the mother board, to a second position which is in engagement with the mother board. Electrical conductors on the insulation layer provide electrical connections between the circuit board and the mother board.

U.S. Pat. No. 4,528,530 issued July 9, 1985 to Ketchen for "Low Temperature Electronic Package having a Superconductive Interposer for Interconnecting Strip Type Circuits" discloses a right angle connector for making right angle electrical connections between vertical substrates and a horizontal substrate.

U.S. Pat. No. 4,581,495 issued Apr. 8, 1986 to Geri et al. for "Modular Telephone Housing" discloses the use of a length of flat cable for making electrical connections in a telephone housing.

U.S. Pat. No. 4,587,596 issued May 6, 1986 to Bunnell for "High Density Mother/Daughter Circuit Board Connector" discloses the use of a multi-layer flexible circuit folded around a housing member to make electrical connections with contact buttons formed on mother and daughter boards in a right angle configuration.

U.S. Pat. No. 4,693,530 issued Sept. 15, 1987 to Stillie et al. for "Shielded Elastomeric Electrical Connector" discloses the use of a multilayer flexible circuit surrounding but not attached to an elastomeric insert to make electrical connections between the conductor pads formed on a mother board and a daughter board in a perpendicular or right angle configuration. The freedom of movement between the flexible circuit and the cylindrical portion of the elastomeric insert reduces the [lateral] stresses on both of those members.

SUMMARY OF THE INVENTION

It is an object of the present invention to provide an electrical connector for connecting a mother board to a daughter board at a substantially right angle, including a housing defining a chamber and having a first slot therein communicating with the chamber. An elastomeric member having a second slot therein in register with the first slot is disposed in the chamber. The elastomeric member has an extending portion protruding out of the chamber, which has first and second axially extending, semi-cylindrical portions separated by a channel. A flexible circuit surrounds the elastomeric member. The flexible circuit has two free ends disposed in the second slot and a middle portion disposed within the channel, whereby electrical contact is made between edge connector pads on the daughter board which is inserted into the first and second slots and the conductors on the flexible circuit, as well as between connector pads on the mother board and the conductors on the flexible circuit surrounding the extending portion of the elastomeric member, as the housing is fastened to the mother board, compressing the elastomeric member.

It is a further object of this invention to provide an electrical connector for connecting a mother board to a daughter board at a substantially right angle having increased force and increased contact area between the mother board connector pads and flexible circuit conductors as the housing of the connector is fastened to the mother board to improve the electrical connection therebetween.

It is a further object of this invention to provide an electrical connector for connecting a mother board to a daughter board at a substantially right angle having a wiping action with the mother board connector pads and flexible circuit conductors as the housing of the connector is fastened to the mother board to improve the electrical connection therebetween.

It is further object of the present invention to provide an electrical connector which does not have to be fastened to a mother board until electrical connections are to be made to a daughter board.

These and other objects of the present invention will become apparent from the drawings and description of the preferred embodiment disclosed herein.

Figure 1:
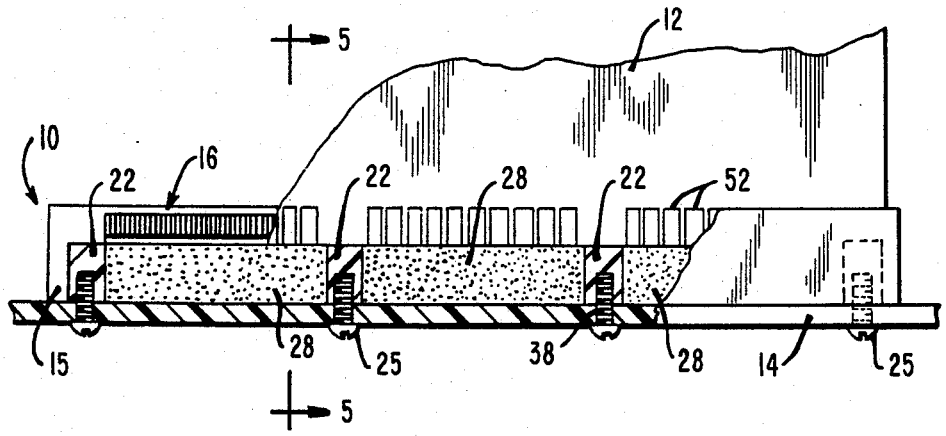
FIG. 1 is a side view of a daughter board connected to a mother board by an electrical connector of the present invention.
Figure 6:
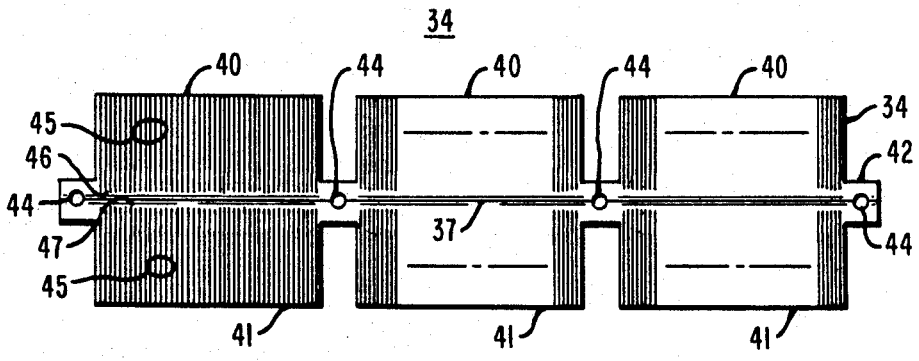
Figure 5:
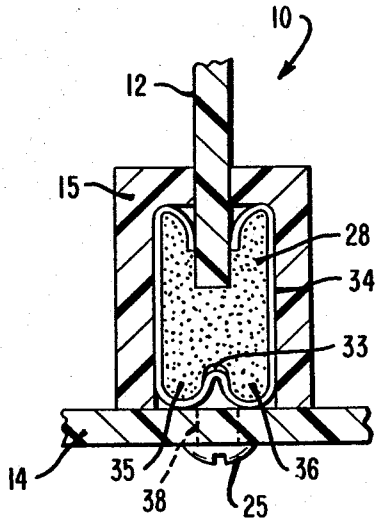
Figure 4:
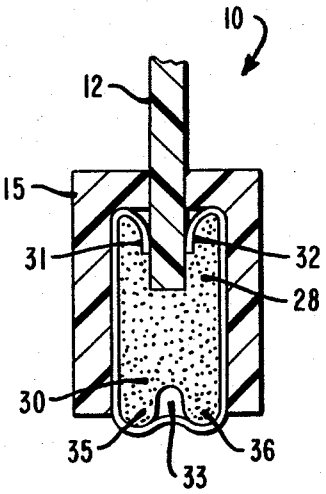
Figure 3:
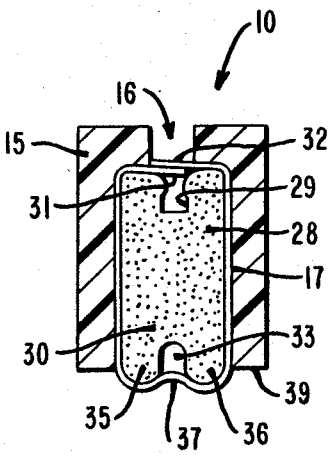
Figure 7:
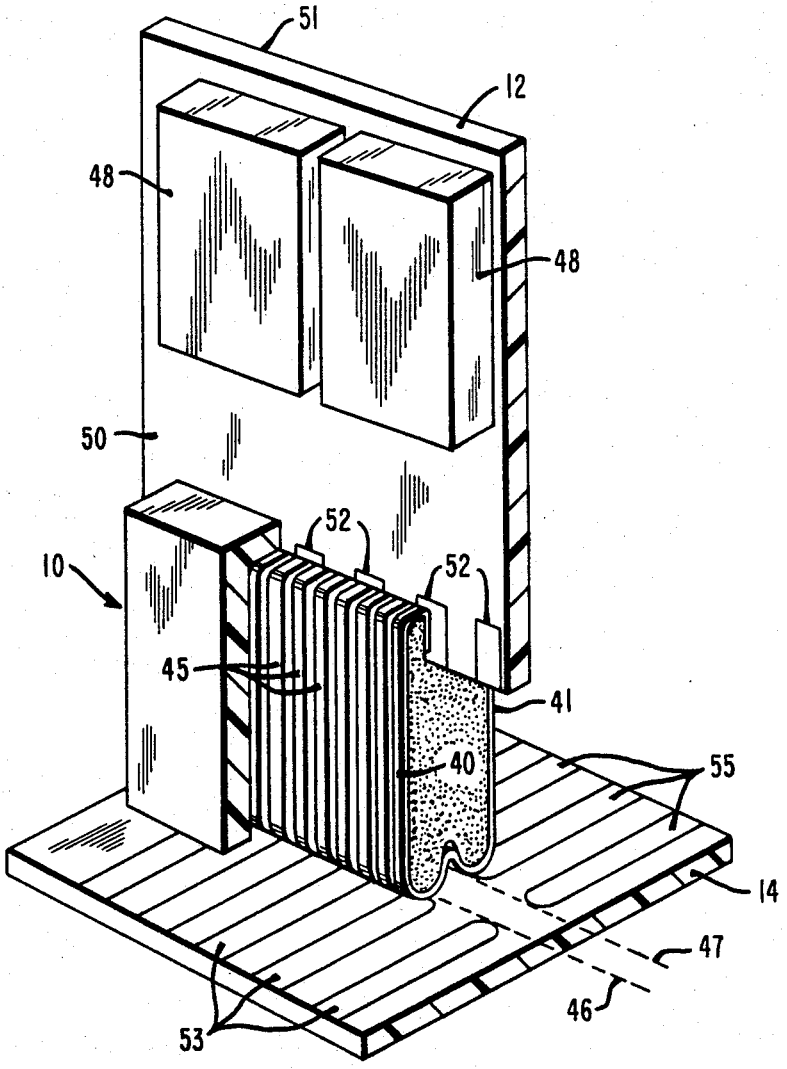
Figure 10:
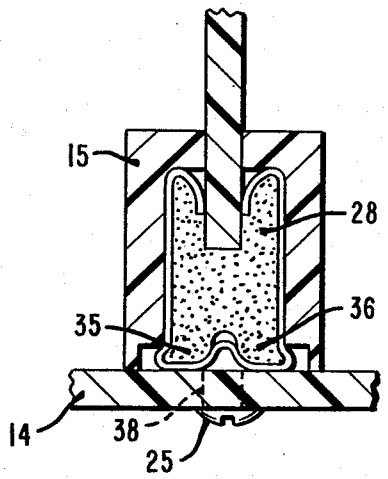
Figure 9:
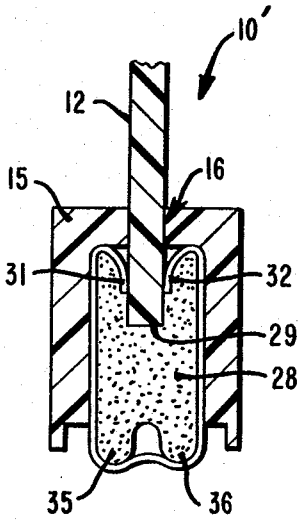
Figure 8:
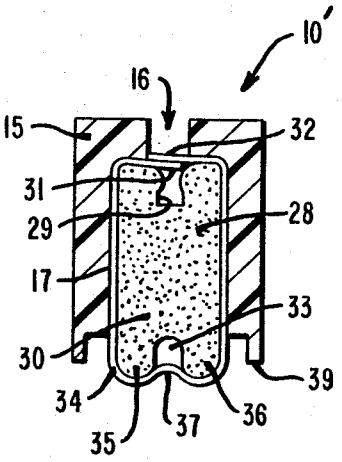
Figure 11:
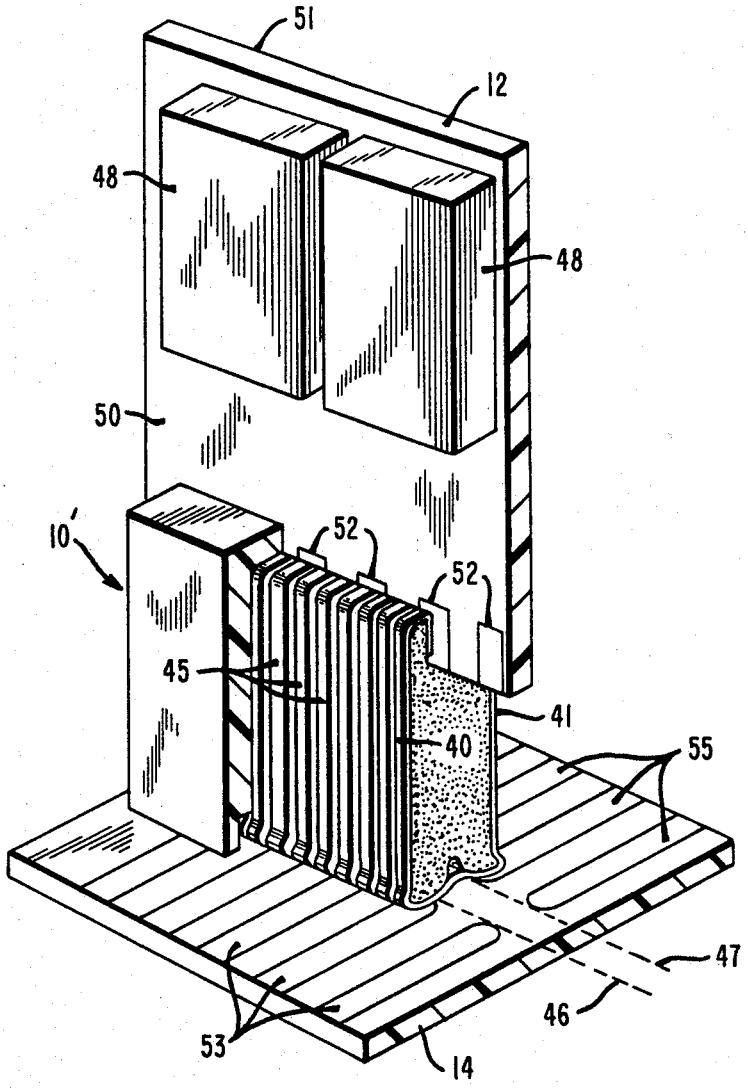

Fgg. 2 is a simplified top view of a housing member of the electrical connector of FIG. 1;

FIG. 3 is a simplified cross sectional view of one embodiment of the electrical connector according to the present invention;

FIG. 4 is a cross sectional view of the electrical connector, as shown in FIG. 3, engaged with the edge of a daughter board;

FIG. 5. is a cross sectional view of the electrical connector, as shown in FIG. 4, engaged with the edge of a daughter board and fastened to a mother board for making electrical connections therebetween;

FIG. 6 is a top view of a flexible circuit of the connector of FIG. 1, wherein the flexible circuit has been rolled out flat;

FIG. 7 is a perspective view of a daughter board connected to a mother board by an electrical connector according to one embodiment of the present invention, wherein portions of the electrical connector have been broken away to show its internal construction;

FIG. 8 is a simplified cross sectional view of an electrical connector according to an alternative embodiment of the invention;

FIG. 9 is a cross sectional view of the electrical connector, as shown in FIG. 8, engaged with the edge of a daughter board;

FIG. 10 is a cross sectional view of the electrical connector, as shown in FIG. 9, engaged with the edge of a daughter board and fastened to a mother board for making electrical connections therebetween; and FIG. 11 is a perspective view of a daughter board connected to a mother board by an electrical connector according to the alternative embodiment of the present invention, wherein portions of the electrical connector have been broken away to show its internal construction.

DESCRIPTION OF THE PREFERRED EMBODIMENT

Figure 2:
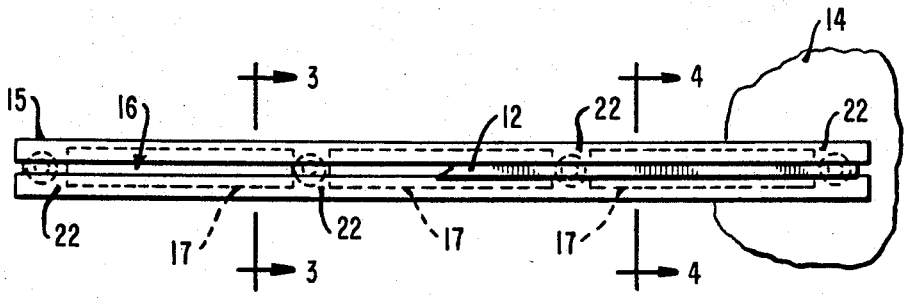

Referring now to FIGS. 1 and 2, there is shown a connector 10 of the present invention for making electrical connection between a daughter board 12 and a mother board 14. The connector 10 includes a connector housing 15, illustrated in FIG. 1 with a portion thereof broken away to expose a portion of the daughter board 12 therein. As seen best in FIG. 2, a slot 16 runs the entire length of the connector housing 15 and communicates with a plurality of chambers 17 into each of which there has been placed an elastomeric member 28. A plurality of solid portions 22 spaced along and at the ends of the housing 15 define the ends of the chambers 17. The top of each chamber 17 extends up to the slot 16 such that the edge of the daughter board 12 may be inserted into the top portion of each chamber 17. The daughter board 12 penetrates through the slot 16 and into each respective chamber 17 until further penetration is stopped by the top surface of the solid portions 22. The solid portions 22 not only serve as stops for the edge of the daughter board 12, but also receive a plurality of screws 25 for connecting the mother board 14 to the connector housing 15, as will be explained.

FIGS. 3, 4 and 5 are simplified cross sectional views of the connector assembly 10 showing how the connector 10 may be assembled for making electrical connections between the daughter board 12 and mother board 14. Each elastomeric member 28 has an upper slot 29 which communicates with the slot 16 in the connector housing 15. The lower portion 30 of each elastomeric member 28 has two semi-cylindrical portions 35 and 36 separated by a channel 33. The two semi-cylindrical portions 35 and 36 are axially parallel to each other and are substantially equal in all dimensions including the extension of each below the bottom 39 of the connector housing 15. The semi-cylindrical portions 35 and 36 of the elastomeric members 28 will be compressed and deformed as the mother board 14 is fastened to the connector housing 15, as will be explained. The elastomeric members 28 may be fabricated of compressible silicone material available from the General Electric Company under the designation SE6140 and having a durometer rating of 40.

A flexible circuit 34, which can be readily manufactured from commercially available materials, is positioned around the periphery of each elastomeric member 28 and trapped between the elastomeric member 28 and the walls of the chamber 17. The flexible circuit 34 has a fold 37 permanently formed along the length of its central strip portion. This fold is positioned partially within the channel 33. The free-ends 31 and 32 of the flexible circuit 34 initially extend in an overlapping fashion across the slot 29 of the elastomeric member 28.

FIG. 4 illustrates a daughter board 12 having one edge inserted into the slot 16 of the connector housing 15 and extending into the slot 29 of the elastomeric member 28. With the edge of the daughter board 12 in the slot 29, the free-ends 31 and 32 are displaced downwards and trapped between the sides of the daughter board 12 and the walls of the slot 29 as the daughter board 12 is inserted into the slot 29. It will be noted that the width of the slot 29 is at least ten per cent less than the thickness of the daughter board 12 such that, as the edge of the daughter board 12 is inserted into the slot 29, the elastomeric material is compressed making a tight connection between the sides of the daughter board 12 and the free-ends 31 and 32. A wiping action between the conductors on the flexible circuit and the edge connector pads of the daughter board 12 is also provided as the edge of the daughter board 12 is inserted into the slot 29.

Referring to FIG. 5, the mother board 14 is connected to the housing member 15 by the plurality of screws 25 which pass through holes 38 in the mother board 14 and are screwed into the solid portions 22 of the housing member 15 (see FIGS. 1 and 2). As the mother board 14 is drawn into a tight engagement with the connector housing 15, the semi-cylindrical portions 35 and 36 of the elastomeric members 28 are compressed against the sides of the chamber 17 and the top of the mother board 14. The semi-cylindrical portions 35 and 36 not only become compressed as they are forced into the smaller volume of the chamber 17, but they also undergo deformation into the volume of the channel 33. This deformation pushes the fold 37 of the flexible circuit 34 between the semi-cylindrical portions 35 and 36, and causes the adjoining portions of the flexible circuit 34 to sweep across the top of the mother board 14 with a wiping action. Each semi-cylindrical portion 35 and 36 traps a portion of the flexible circuit 34 against the mother board connector pads and secures a portion of the flexible circuit 34, which is adjacent to the fold 37, into the now diminished channel 33.

FIG. 6 illustrates the flexible circuit 34 in a rolled-out-flat condition before it has been formed around the elastomeric members 28 (see FIGS. 3–5). The flexible circuit 34, which can be formed of polyimide or other similar commercially available material, has a number of opposed extending panels 40 and 41 extending from a central strip 42. The extending panels 40 and 41 are sized such that, when they are positioned around opposite sides of individual elastomeric members 28, the extending panels 40 and 41, and associated elastomeric members 28, will fit into the chambers 17 of the connector housing 15 (see FIGS. 1 and 2). The center strip 42 includes holes 44 located on its ends and along its length between the pairs of extending panels 40 and 41 for registering with the holes 38 through the mother board 14. It will thus be understood that the screws 25 pass through the holes 38 and 44 into the solid portions 22 of the connector housing 15 when the mother board 14 is fastened to the connector housing 15, as described in connection with FIG. 5. The flexible circuit 34 has etched, gold plated copper conductors 45 on the extending panels 40 and 41 extending partially into the connecting strip 42 and ending at reference numbers 46 and 47. This allows a separate circuit on each side of the daughter board 12 to be connected to a separate circuit on the mother board 14, as will be discussed in connection with FIG. 7. It will be understood that, rather than a single integrated structure as seen in FIG. 6, flexible circuit 34 could be replaced with separate and unjoined individual flexible circuits, each having paired extending panels 40 and 41 and each for being placed around one of the elastomeric members 28 in one of the chambers 17.

FIG. 7 is a perspective view of the connector 10 of the present invention with the housing 15 broken away to show the electrical connections between edge connector pads 52 leading to electronic components, such as integrated circuits (ICs) 48 on the daughter board 12, and printed circuit connector pads 53 and 55 on the mother board 14. The daughter board 12 has a first side 50 and a second side 51, each having separate edge connector pads 52 thereon. The mother board 14 may include two separate printed circuits, with one of the two circuits connected to pads 53 nd the other to pads 55. In the illustrated embodiment of FIG. 7, the edge connector pads 52 of the circuit on side 50 of the daughter board 12 are connected to the connector pads 53, and the separate edge connector pads (not shown) on side 51 are connected to the connector pads 55. As discussed in connection with FIG. 6, the flexible circuit 34 around the elastomeric members 28 includes gold plated conductors 45 on each of the extending panels 40 and 41. The conductors 45 may be interrupted at lines 46 and 47 such that there is no electrical continuity between the conductors 45 on extending panel 40 and the conductors 45 on extending panel 41 (not shown in FIG. 7) of the flexible circuit 34. The edge connector pads 52 and the printed circuit connector pads 53 and 55 are 0.050 inches wide on 0.100 inch center-to-center spacing. The gold plated conductors 45 on the flexible circuit 34 are 0.010 inches wide on 0.020 inch center-to-center spacing. Thus, as shown in FIG. 7, at least two of the conductors 45 lead from each of the edge connector pads 52 to the connector pads 53 and 55 which are to be electrically connected.

FIGS. 8, 9 and 10 are simplified cross sectional views of a connector 10′ showing an alternative way for making electrical connections between the daughter board 12 and mother board 14. The connector 10′ includes elastomeric members 28, each sized to be fitted into the upper portion of one of the chambers 17 of the connector housing 15. In this alternative embodiment, each chamber 17 widens substantially at the bottom 39 of the housing 15. Each elastomeric member 28 has an upper slot 29 which communicates with the slot 16 in the connector housing 15. The lower portion 30 of each elastomeric member 28 has two semi-cylindrical portions 35 and 36 separated by a channel 33. The two semi-cylindrical portions 35 and 36 are axially parallel to each other and are substantially equal in all dimensions including the extension of each below the bottom 39 of the connector housing 15. The semi-cylindrical portions 35 and 36 of the elastomeric members 28 will be compressed and deformed as the mother board 14 is fastened to the connector housing 15, as will be explained. The elastomeric members 28 may be fabricated as described previously with regard to FIG. 3.

The same type of flexible circuit 34 is positioned around the periphery of each elastomeric member 28 and trapped between the elastomeric member 28 and the upper walls of the chamber 17. The flexible circuit 34 has a fold 37 permanently formed along the length of its central strip portion. This fold is positioned partially within the channel 33. The free-ends 31 and 32 of the flexible circuit 34 initially extend across the slot 29 of the elastomeric member 28.

FIG. 9 illustrates a daughter board 12 having one edge inserted into the slot 16 of the connector housing 15 and extending into the slot 29 of the elastomeric member 28. With the edge of the daughter board 12 in the slot 29, the free-ends 31 and 32 are displaced downwards and trapped between the sides of the daughter board 12 and the walls of the slot 29 as the daughter board 12 is inserted into the slot 29. It will be noted that the width of the slot 29 is at least ten per cent less than the thickness of the daughter board 12, such that as the edge of the daughter board 12 is inserted into the slot 29, the elastomeric material is compressed, thereby making a tight connection between the sides of the daughter board 12 and the free-ends 31 and 32. A wiping action between the conductors on the flexible circuit and the edge connector pads is also provided as the edge of the daughter board 12 is inserted into the slot 29.

Referring to FIG. 10, the mother board 14 is connected to the housing member 15 by the plurality of screws 25 which pass through holes 38 in the mother board 14 and are screwed into the solid portions 22 of the housing member 15 (see FIGS. 1 and 2). As the mother board 14 is drawn into a tight engagement with the connector housing 15, the semi-cylindrical portions 35 and 36 of the elastomeric members 28 are compressed against both the upper sides and the lower widened sides of the chamber 17, as well as the top of the mother board 14. The semi-cylindrical portions 35 and 36 not only become compressed as they are forced into the smaller volume of the chamber 17, but they also undergo deformation. The semi-cylindrical portions 35 and 36 deform into the volume of the lower, widened sides of the chamber 17 and into the volume of the channel 33. This deformation traps the flexible circuit 34 between the semi-cylindrical portions 35 and 36 and the top of the mother board 14. The force of the semi-cylindrical portions 35 and 36 flattens the conductors of the flexible circuit 34 upon the connector pads of the mother board 14 and thereby increases the amount of conductor area for electrical contact.

The flexible circuit 34 used in the alternative embodiment shown in FIGS. 8 through 11 is substantially identical to the flexible circuit 34 described previously in regard to FIG. 6 and, therefore, the details about the flexible circuit 34 are not further described here.

FIG. 11 is a perspective view of the connector 10' according to the present invention with the housing 15 broken away to show the electrical connections between edge connector pads 52 leading to electronic components, such as integrated circuits (ICs) 48 on the daughter board 12, and printed circuit connector pads 53 and 55 on the mother board 14. The daughter board 12 has a first side 50 and a second side 51, each having separate edge connector pads 52 thereon. In the illustrated embodiment of FIG. 11, the edge connector pads 52 of the circuit on side 50 of the daughter board 12 are connected to the connector pads 53, and separate edge connector pads on side 51 (not shown) are connected to the connector pads 55. As discussed in connection with FIG. 6, the flexible circuit 34 around the elastomeric members 28 includes gold plated conductors 45 on each of the extending panels 40 and 41. The conductors 45 may be interrupted at lines 46 and 47 such that there is no electrical continuity between the conductors 45 on extending panel 40 and the conductors 45 of the extending panel 41 (not shown in FIG. 11) of the flexible circuit 34. The edge connector pads 52 and the printed circuit connector pads 53 and 55 are 0.050 inches wide on 0.100 inch center-to-center spacing. The gold plated conductors 45 on the flexible circuit 34 are 0.010 inches wide on 0.020 inch center-to-center spacing. Thus, as shown in FIG. 11, at least two of the conductors 45 lead from each of the edge connector pads 52 to the connector pads 53 and 55 which are to be electrically connected.

It will be seen that the disclosed embodiments of the present invention are inexpensive in that pins and pin connections are not required. Furthermore, electrical connections will be made even if either the connector assembly 10 or the connector assembly 10', and/or the flexible circuit 34 in either, are slightly skewed or offset. The connector assemblies 10 and 10' also provide for right angle contact between a mother board 14 and daughter board 12, which does not require expensive, often unused, mating connectors on a mother board, allows for right angle contact between two circuits on the mother board 14 with two circuits on the daughter board 12, allows for the changing of the daughter board 12 without removal of the connector assembly 10 or 10', and provides for ease of interconnect changes by revising the conductor pattern on the flexible circuit 34. It will also be understood that neither the connector 10 nor connector 10' must be added to the mother board 14 until it is desired to add a daughter board 12. Thus, neither the connector 10 nor the connector 10' is typically added to the mother board 14 in anticipation of additional daughter boards 12 (such as additional memory boards) being added at a later time, but may be quickly and easily added with only a screwdriver at the time additional daughter boards 12 are actually added. Furthermore, it will be understood that, if printed circuits are printed on both sides of the mother board 14, a connector 10 or 10' may be attached to both sides of the mother board 14 to provide for the connection of daughter boards 12 on each side of the mother board 14, if desired.

Thus, a connector has been described which provides the aforementioned objects. It will be understood by those skilled in the art that the disclosed embodiments are exemplary only, and that the various elements disclosed may be replaced by equivalents without departing from the invention hereof, which equivalents are intended to be covered by the appended claims.

I claim:

1. An electrical connector for connecting a mother board to a daughter board at a substantially right angle, comprising:

a housing defining a chamber and having a first slot therein communicating with the chamber;

an elastomeric member having a second slot therein in register with the first slot, the elastomeric member disposed in the chamber and having an extending portion protruding out of the chamber;

the extending portion including first and second axially extending, semi-cylindrical portions separated by a channel; and a flexible circuit having conductors and surrounding the elastomeric member, the flexible circuit having two free ends for being disposed in the second slot and a middle portion for being disposed within the channel, whereby electrical contact is made between edge connector pads on the daughter board inserted into the first and second slots and the conductors on the flexible circuit, as well as electrical contact between connector pads on the mother board and the conductors of the flexible circuit surrounding the extending portion of the elastomeric member, as the housing is fastened to the mother board compressing the elastomeric member.

2. The electrical connector, according to claim 1, wherein the housing further defines a lower, widened portion of the chamber communicating with the remainder of the chamber, whereby as the housing is fastened to the mother board, the extending portion of the elastomeric member is compressed and deformed along the surface of the mother board and into the lower, widened portion of the chamber as well as into the channel, increasing the force and the contact area between the conductors of the flexible circuit and the connector pads of the mother board to improve the electrical connection therebetween.

3. An electrical connector as set forth in claim 2, wherein electrical contact with each connector pad of the daughter board and with each connector pad of the mother board is effected by at least two conductors of the flexible circuit.

4. An electrical connector as set forth in claim 3, wherein:

housing has means for receiving a fastener;

the flexible circuit has a hole therein for allowing the passage of a fastener to the fastener receiving means; and the mother board has a hole therein for allowing the passage of the fastener to the fastener receiving means enabling the right angle connector to be fastened on to the mother board for connection to the daughter board.

5. The electrical connector, according to claim 1, wherein as the housing is fastened to the mother board, the flexible circuit and the first and second semi-cylindrical portions are deformed into the channel in a sweeping motion, wiping the conductors of the flexible circuit against the connector pads of the mother board to improve the electrical connection therebetween.

6. An electrical connector as set forth in claim 5, wherein electrical contact with each connector pad of the daughter board and with each connector pad of the mother board is effected by at least two conductors of the flexible circuit.

7. An electrical connector as set forth in claim 6, wherein:

the housing has means for receiving a fastener;

the flexible circuit has a hole therein for allowing the passage of a fastener to the fastener receiving means; and the mother board has a hole therein for allowing the passage of the fastener to the fastener receiving means enabling the electrical connector to be fastened on to the mother board for connection to the daughter board.

* * * * *